United States Patent [19]

Alexander et al.

[11] Patent Number: 4,672,795

[45] Date of Patent: Jun. 16, 1987

[54] METHOD OF HANDLING FIFTH PANEL PACKAGES AND ASSEMBLY THEREFOR

[75] Inventors: James Alexander, Cedar Knolls; Wilhelm B. Bronander, III, Upper Montclair, both of N.J.

[73] Assignee: Scandia Packaging Machinery Co., Clifton, N.J.

[21] Appl. No.: 806,153

[22] Filed: Dec. 6, 1985

[51] Int. Cl.[4] ..... B65B 35/56

[52] U.S. Cl. ..... 53/446; 53/544; 128/374; 128/417; 414/55

[58] Field of Search ..... 53/142, 143, 446, 447, 53/448, 544, 443; 198/374, 417; 414/31, 55, 56

[56] References Cited

U.S. PATENT DOCUMENTS

| | | | |
|---|---|---|---|
| 3,143,223 | 8/1964 | McIntyre et al. | 414/31 |
| 3,329,252 | 7/1967 | Anderson | 53/446 X |
| 3,332,561 | 7/1967 | Hedborg | 414/31 |
| 4,192,415 | 3/1980 | Krener | 53/143 X |
| 4,269,557 | 5/1981 | Kidd | 414/31 X |
| 4,530,435 | 7/1985 | Stohquist | 53/143 X |

*Primary Examiner*—R. L. Spruill
*Assistant Examiner*—Steven P. Weihrouch
*Attorney, Agent, or Firm*—Neil F. Markva

[57] ABSTRACT

The assembly performs the method of handling packages having a panel extending outwardly from one side of the package and along one edge thereof. A plurality of such contiguously nested packages is provided with the extending panel of each package disposed in the same direction and overlapping the side of the next adjacent juxtaposed package. The end package of the plurality of nested packages has its extending panel directed outwardly from the plurality and is rotated to cause the extending panel thereof to be placed in an overlapping relationship with respect to the next adjacent juxtaposed package. The plurality of packages being fed to the work station of the end package rotation process is acted upon in a particular manner to cause them to shift with respect to each other to produce a substantially uniform overlapping disposition of the outwardly extending panels with respect to the side of the next adjacent juxtaposed panel. At the end package rotation work station, a selected number of nested packages is acted upon to separate the end package to a position away from the other packages selected, to rotate and then to bring back into a contiguous relationship so that a bundle of packages is formed without an end panel extending outwardly from that bundle. The bundled packages are then directed into a standard wrapping machine for overwrapping the bundle in a manner precisely the same as if there were no fifth panel extended outwardly from the packages being wrapped.

39 Claims, 27 Drawing Figures

METHOD OF HANDLING FIFTH PANEL PACKAGES AND ASSEMBLY THEREFOR

FIELD OF THE INVENTION

This invention relates generally to the handling of packages in preparation for a wrapping operation. More particularly, the invention relates to the preparation of packages for overwrapping wherein the packages have a panel extending outwardly from one side of the package and along one edge thereof.

BACKGROUND OF THE INVENTION

The use of a panel extending outwardly from one side of a package for the placement of advertisements and for display purposes is commonplace in marketing. Generally, the packages are wrapped in a nested condition with the top outwardly extending panels extending all in one direction and outwardly from a bundle of packages from the one end package. Then, bubble packaging is used to encase the plurality of nested packages having such an outwardly extending panel. Where there are four substantially identical rectangular side panels, the outwardly extending panel constitutes a fifth panel directed outwardly from the intersection of two of the four rectangular side panels.

Standard overwrapping machines cannot be readily adapted to the packaging of a plurality of such packages having a fifth panel. The outwardly extending fifth panel on the end package of any plurality of packages creates a special handling problem that precludes the use of such overwrapping machines. Thus, special machines have had to be developed or particular techniques generated to bundle and wrap a plurality of nested packages having an end package with its extending panel directed outwardly from the plurality of the nested packages.

PURPOSE OF THE INVENTION

The primary object of this invention is to provide a method of and an apparatus for handling packages having a panel extending outwardly from one side of the package and along one edge thereof so that such packages can be quickly and easily bundled and then overwrapped in the standard overwrapping machines used to wrap packages having no fifth panel.

Another object of the invention is to provide a method of and an assembly for handling packages with a fifth panel under high speed conditions so that high speed overwrapping machines may be used to accomplish an otherwise more complex method of wrapping such packages.

A further purpose of the invention is to provide a means for enhancing the nesting of packages having such a fifth panel in preparation for the high speed overwrapping process being used for wrapping the plurality of nested packages in a bundled condition.

SUMMARY OF THE INVENTION

The method as described herein is directed to a method of and an assembly for handling packages having a fifth panel. That is, the fifth panel extends outwardly from one side of the package and along one edge thereof. A plurality of such packages with the fifth panel disposed in the same direction is contiguously nested with respect to each other so that each extending panel overlaps the side of the next adjacent juxtaposed package. With the plurality of packages provided in such a fashion, the end package of any plurality of the nested packages has its extending fifth panel directed outwardly from that plurality of nested packages. The end package is rotated to cause the extending panel thereof to be placed in an overlapping relationship with respect to the next adjacent juxtaposed package. Thus, in any selected number of such nested packages having the end package rotated, there is no longer any fifth panel extending from such a bundle of nested packages. Such a bundle is then ready for high speed overwrapping machines.

Under actual conditions of feeding fifth paneled packages to a wrapping station, it has been found that there is difficulty in obtaining a uniform nesting of the packages as they come down the conventional conveyor belt for feeding such packages into a wrapping station. Failure to nest properly produces an unevenly disposed fifth panel which may either be turned upwardly or downwardly with respect to the next contiguously adjacent package. The pressure of the packages being fed to an end work station where they are held stationary while the conveyor belt moves therebelow causes them to be locked in the undesirable nonuniform condition.

Thus, a particular feature of the invention is the means for enhancing the nesting condition of the packages being fed into the bundling work station in preparation for overwrapping. Such nesting enhancing means includes means for shifting the packages with respect to each other while they are disposed on a standard conveyor belt for such packages. In a specific embodiment, the nesting enhancing means includes roller means disposed below the packages to cause them to shift with respect to each other thereby producing a substantially uniform overlapping disposition of the outwardly extending fifth panels with respect to the side of the next adjacent juxtaposed package.

Another feature of the invention is the use of an end package rotation work station. Here a rotating means includes means for turning the end package to cause the extending panel thereof to be placed in an overlapping relationship with respect to the next adjacent juxtaposed package. This eliminates the condition of having the fifth panel extending outwardly from a bundle of the nested packages.

In a specific embodiment of the invention, the rotating means includes means for turning the end package in a rotational direction within a plane parallel to the direction in which the panel outwardly extends. At the same time, it is within the contemplation of the invention to have the end package turned in a rotational direction within a plane disposed transversely with respect to the direction in which the panel outwardly extends. The turning operation involves a half revolution of 180°.

A particular feature of the invention is found in a specific embodiment wherein the plurality of packages is moved along a path extending in the direction transverse to a direction in which the extending panels are outwardly disposed. This takes place at a package rotation work station. Conveyor means moves the number of packages along a supporting surface means which includes means defining a package path having separated branches located between a package ingress section and a package discharge section within the end package rotation work station. One of the separated branches directs the end package along the package path and the other of the separated branches directs the next adjacent juxtaposed package along the package path a spaced distance from the end package. The rotating means is disposed along the separated end package branch and includes a means for vertically shifting the end package with respect to the next adjacent juxtaposed package so that rotation of the end package can be effected. The rotating means includes extending panel contact means fixedly disposed on the supporting surface means to engage the extending panel of the end package thereby urging the package to be rotated as the conveyor means moves the packages along the path in the package rotation work station. Thus, the rotating step of the method is effected simultaneously with the moving of the packages through the work station.

Once the end package has been rotated after being laterally separated from the next adjacent package, the package is then acted upon to redispose it contiguously to the next adjacent package. This includes both a vertical and a lateral redisposition of the end package with respect to the next adjacent juxtaposed package.

The method and assembly for effecting the handling of packages may be applied to the situation where each overlapping extending panel is below or on top of the plurality of packages being acted upon in the end package rotation work station.

BRIEF DESCRIPTION OF THE DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
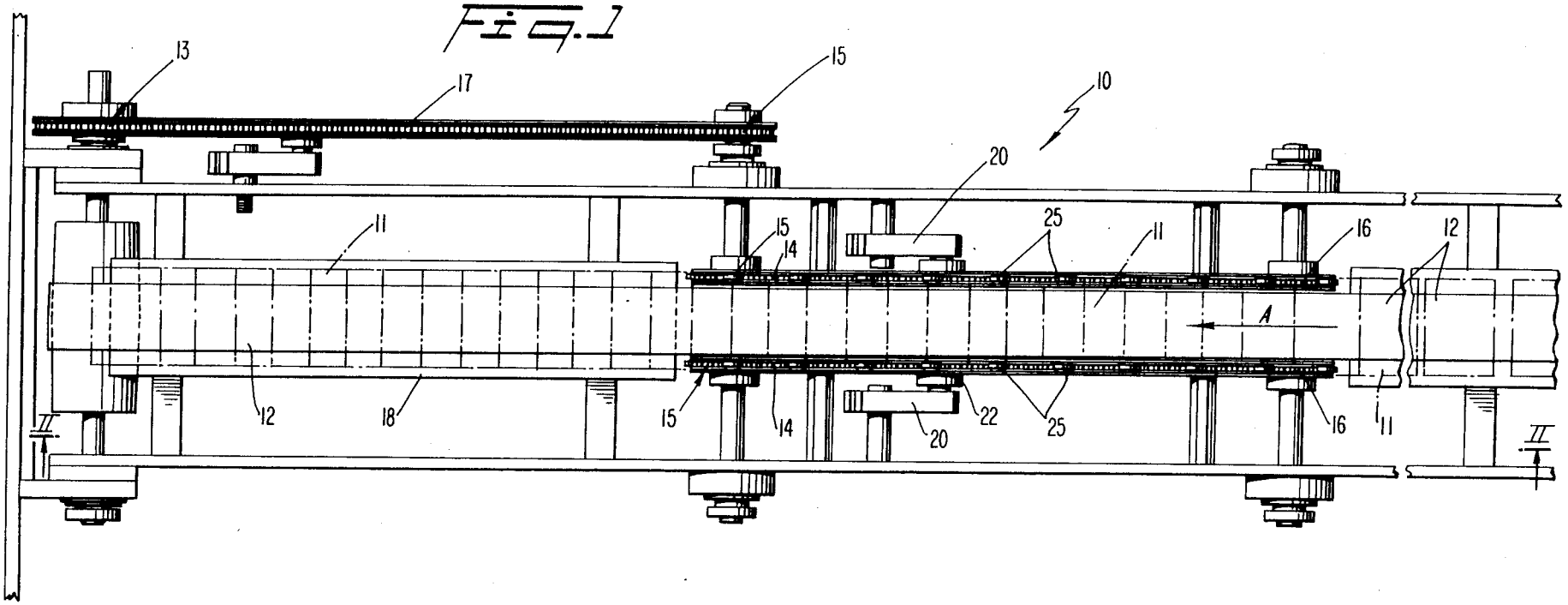
FIG. 1 is a top plan view of a nesting enhancing mechanism made in accordance with this invention.
Figure 2:
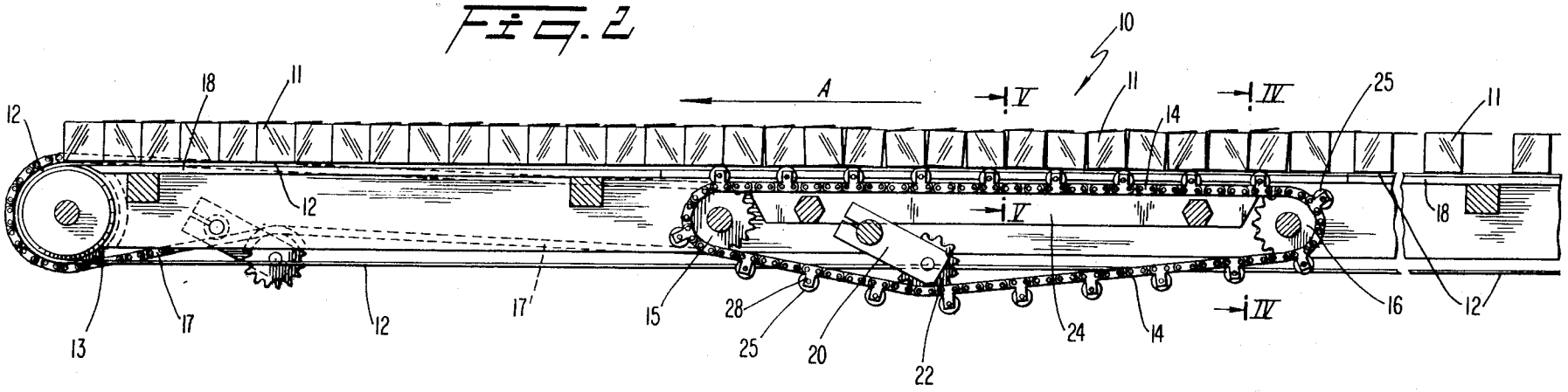
FIG. 2 is a side elevational view of the mechanism of FIG. 1.
Figure 3:
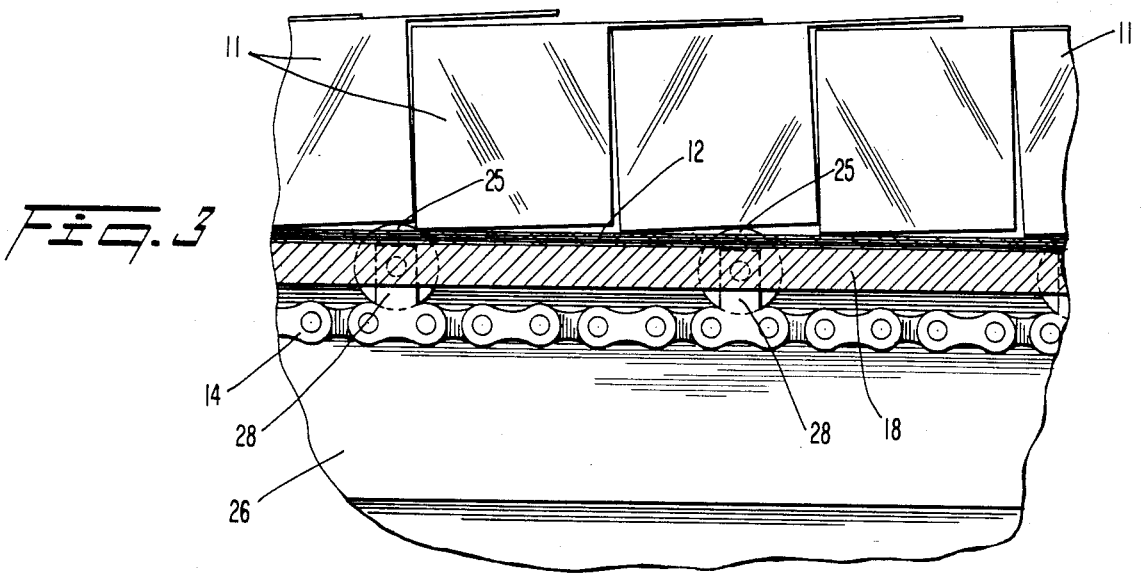
FIG. 3.is a fragmentary detailed side elevational view partly in section of the mechanism as shown in FIG. 2.
Figure 4:
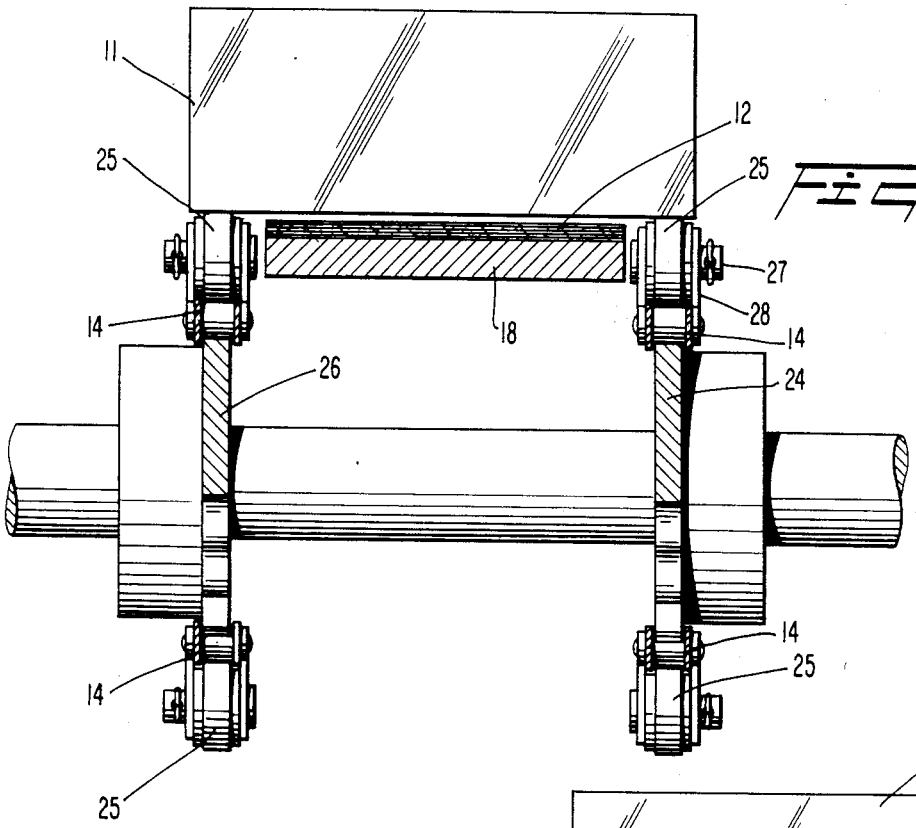
FIG. 4 is a sectional view taken along line IV—IV of FIG. 2.
Figure 5:
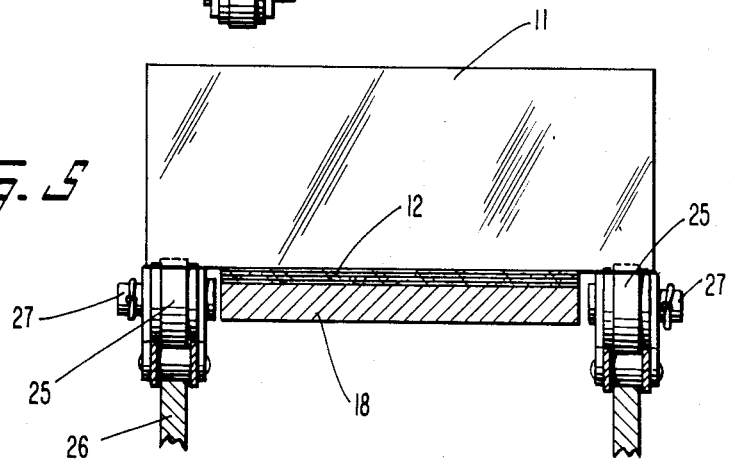
FIG. 5 is a sectional view taken along the line V—V of FIG. 2.
Figures 6, 7:
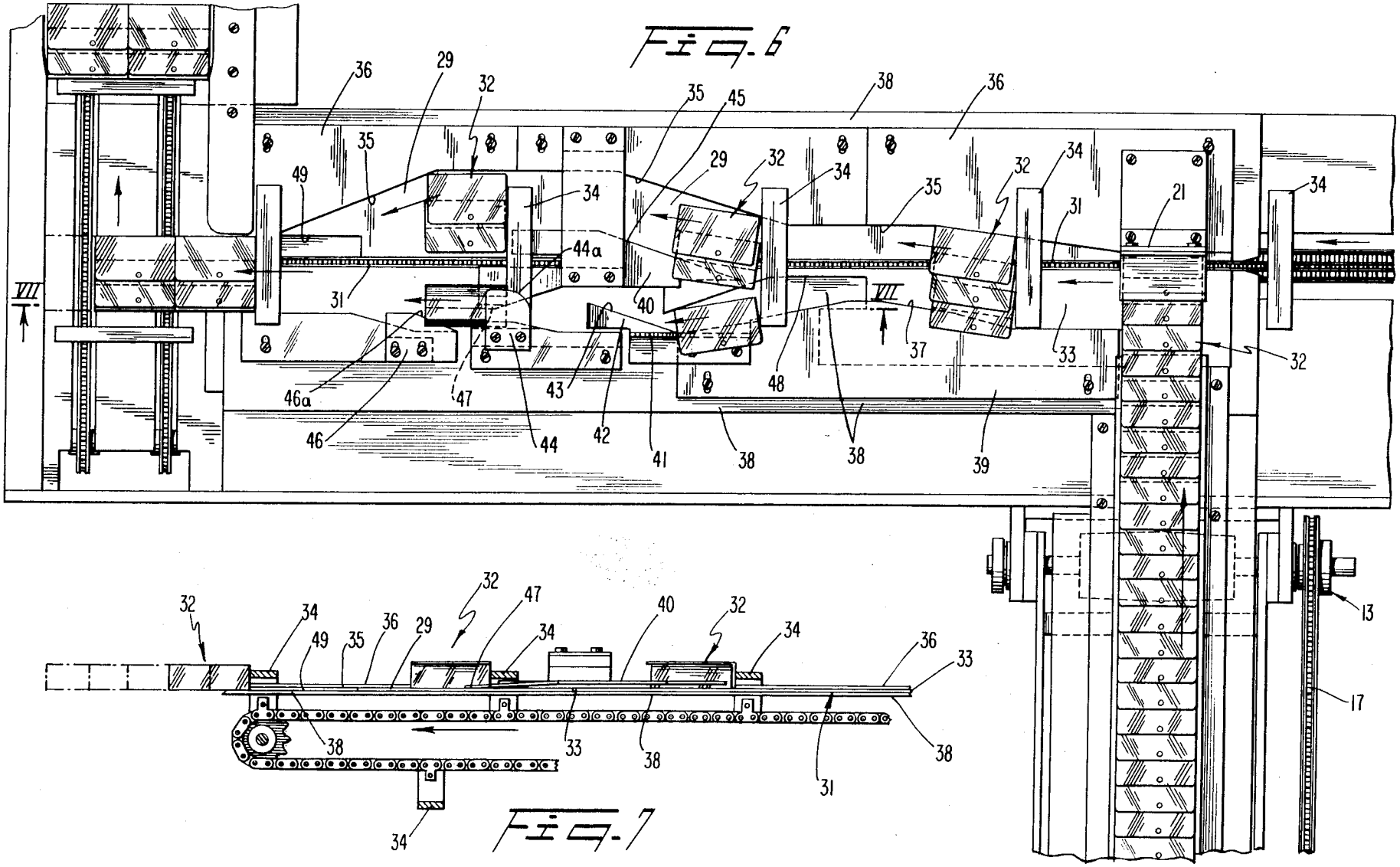
FIG. 6 is a top plan view of an assembly defining an end package rotation work station made in accordance with this invention.
FIG. 7 is a fragmentary side elevational view of the conveyor means moving through the work station as shown in FIG. 6.
Figures 8, 9, 10, 11, 12:
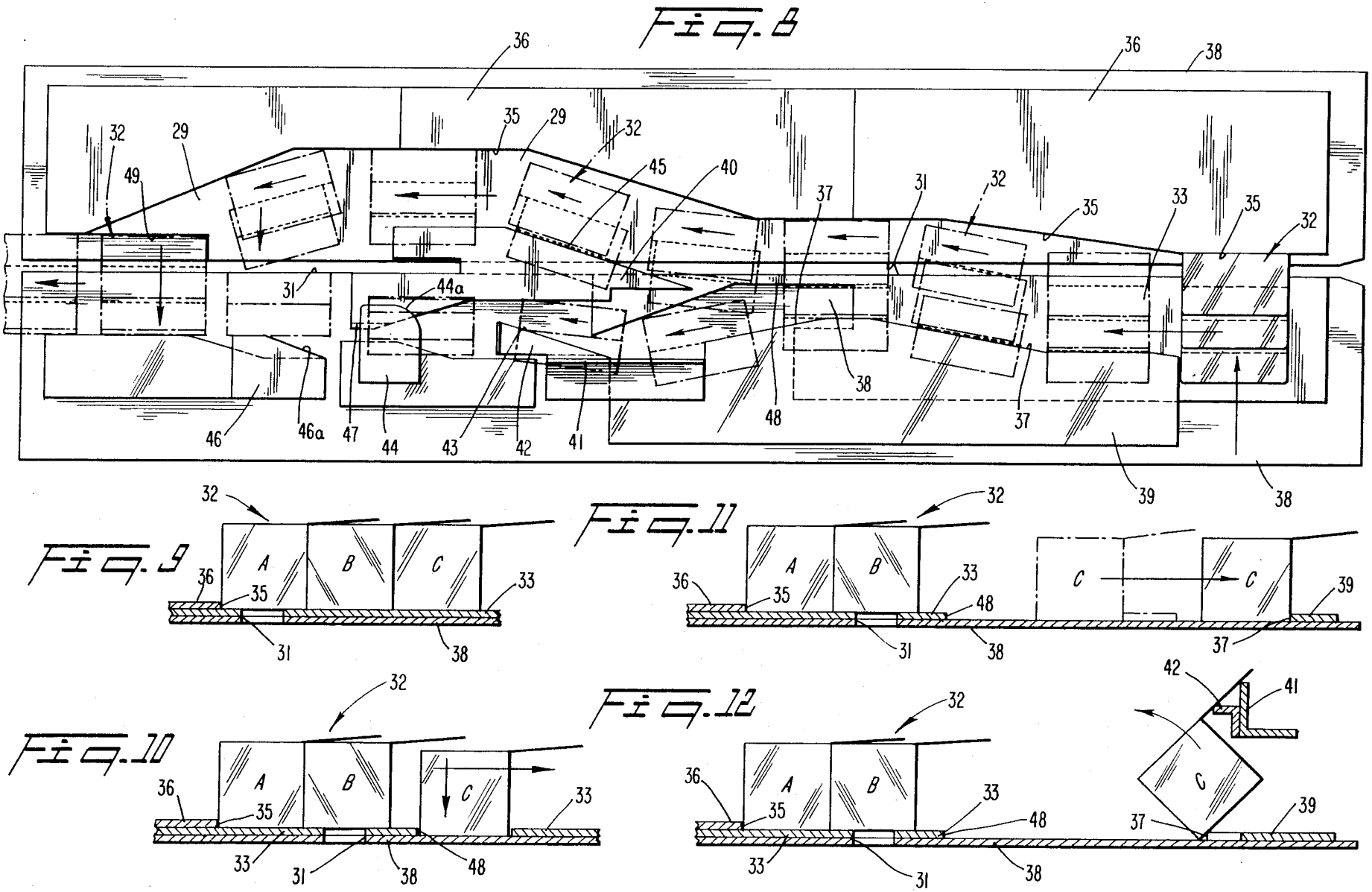
FIG. 8 is a top elevational view showing movement of a plurality of nested packages moving along separated branches in the end package rotation work station.
FIGS. 9 through 17 show an embodiment of the method of the invention whereby the end package is rotated through a half revolution while in the separated position with respect to the next adjacent juxtaposed package in the rotation work station.
Figure 13:
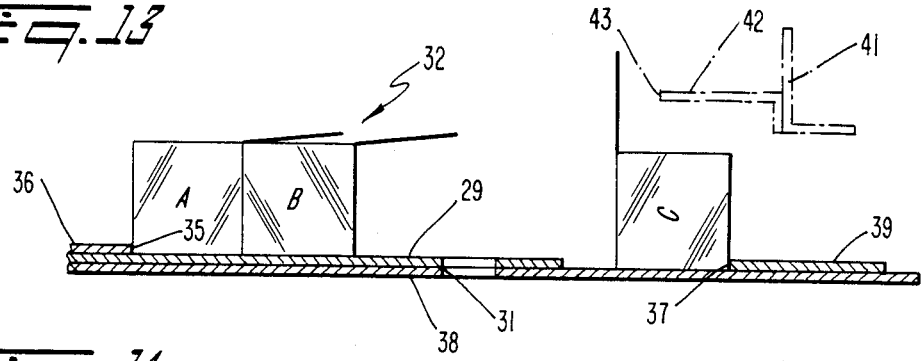
Figure 14:
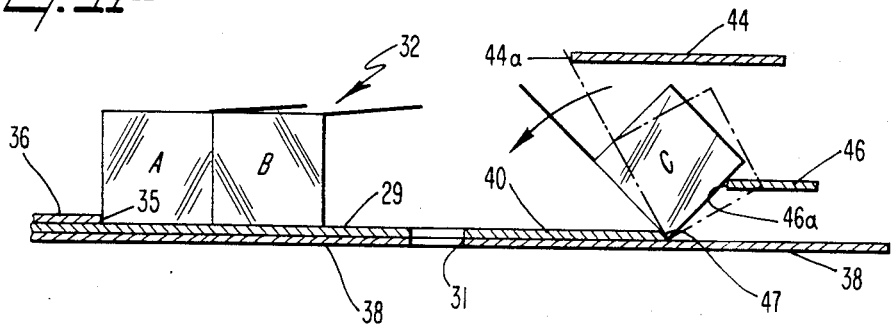

FIGS. 1 through 5 show an assembly, generally designated 10, used for enhancing the nesting of the plurality of packages 11 being fed to the package rotation work station generally designated 30 in FIG. 6.

Packages 11 are disposed on the conveyor belt 12 driven by the sprocket drive assembly, generally designated 13. Packages 11 move to the end of a first path 32 of movement to a feed stop member 21 as shown in FIG. 6. The packages 11 in this embodiment have four substantially identical rectangular side panels with the outwardly extending panel being a fifth panel directed outwardly from the intersection of two of the four rectangular side panels. The fifth panel for each of the boxes 11 trails the box itself as is clearly shown in FIG. 2 and overlaps the next adjacent package. Each overlapping extending panel is above the plurality of packages 11 as shown. While the packages 11 are stopped, the conveyor belt 12 runs continuously to feed incoming packages to the inlet of the package rotation work station 30.

If the packages fail to nest properly and uniformly before they reach the last section of conveyor belt 12, the line pressure from packages 11 behind them will lock the packages 11 in that nonuniform nested condition. That is, the extended panel may be either flipped up or bent downwardly with respect to the next adjacent juxtaposed package. This type of nonuniformity will adversely affect movement of these packages through the subsequent end package rotation work station. Assembly 10 is designed to provide a controlled rocking or shifting of packages 11 while they are being conveyed along the direction designated by arrow A on conveyor belt 12.

Assembly 10 includes closed loop chains 14 mounted around sprocket assemblies 15 and 16 and carrying roller members 25. As shown, roller members 25 extend a very limited distance above the conveyor belt 12 which passes along support member 18. Each roller member 25 is mounted on a bracket 28 via a pin 27. Bracket 28 in turn is directly connected to the links of chains 14 riding along the top edge of rail support members 24 and 26 as clearly shown in FIG. 4.

Thus, as conveyor belt 12 moves packages 11 along a first path to cause the packages to move in an initial direction of movement parallel to the direction in which the extending panels are disposed, the nesting enhancing assembly 10 causes the packages to shift with respect to each other thereby producing a substantially uniform overlapping disposition of the panels with respect to the side of the next adjacent package. Roller members 25 are shown mounted on closed loop chains 14 which move below the packages as discussed above. A tightening assembly is provided for each of the chains 14 and includes a movably adjustable bracket 20 and a sprocket 22 which enable the appropriate tension to be placed in the respective chains 14. The drive assembly 15 is shown to be driven directly off the same drive assembly 13 via chain 17.

The assembly 10 may be adapted to work on cartons or boxes whether the panel is on the top or bottom side of the next adjacent juxtaposed package and whether the panel is either leading or following with respect to the direction of movement for the packages. The speed of the roller chains 14 may be varied with respect to the conveyor belt 12 by simply changing the sprocket ratio on the respective drive assemblies. The desired nesting capability was found to work very well when the belt 12 and the chains 14 ran at the same speed.

The FIGS. 6 through 17 are directed to a first embodiment of a method and apparatus of handling a plurality of packages, generally designated 23, with an extending panel of each package disposed in the same direction. Packages 23 are individually designated A, B, and C in FIGS. 9 through 17. At the entrance of the end package rotation work station 30, the packages are contiguously nested with respect to each other with each extending panel overlapping the side of the next adjacent juxtaposed package.

The plurality of the nested packages 23 includes the end package C with its extending panel directed outwardly from the plurality of nested packages. In this specific embodiment, each overlapping extending panel is above the plurality of packages with the end package C being laterally separated from the next adjacent package B. The plurality of packages 23 is moved along a path extending in a direction normal to the direction in which the extending panels are outwardly disposed. Pusher member 34 moves the plurality of packages 23 completely through the entire length of the end package rotation work station 30.

Upon entrance into work station 30, packages 23 move along the upper support plate 33 while being guided through work station 30 via the guide edges 35 and 37 on guide plates 36 and 39, respectively. Outer plate guide edge 37 provides the guiding of the end package C through the end package branch of the work station 30. The guide edge 35 forms the basis for directing the juxtaposed packages A and B through the separated second branch along the supporting surface 33 located between the package ingress section and the package discharge section of work station 30.

Rotating means is disposed along the separated end package branch and includes means for vertically shifting the end package C with respect to the next adjacent juxtaposed package B. The support plate 38 for the end package C is located below the upper support plate 33. An inner box plate guide edge 47 is located adjacent the support plate 38. A chain slot 31 extends the entire length of the work station 30 to provide space for the chain carrying the pusher members 34 therethrough. The branch separating member 40 includes a pointed outer portion which physically separates the end package C from the juxtaposed package B which moves along the plate guide edge 45 defining the branch for the next adjacent juxtaposed packages A and B.

The panel contact lifting ramp 41, the panel planar contact element 42, and the panel urging element 44 constitute extending panel contact means fixedly disposed on the supporting surface means to engage the extending panel of end package C thereby urging the end package to be rotated as the pusher member 34 of the conveyor means moves the packages 23 along the path through work station 30. The rotation of end package C is effected after being vertically shifted downwardly onto support plate 38 and laterally disposed by guide edge 47. The elements 41, 42, 44 and 46 constitute means for turning the end package C in a rotational direction within a plane parallel to the direction in which the panel outwardly extends from the package C. In this embodiment, the plurality of packages 23 moves at substantially right angles to the direction in which the extending panels are disposed. Clearly, the rotating step is effected simultaneously with the moving step of the method. The extending panel of end package C is acted upon directly by the lifting ramp 41, the panel contact element 42, and inwardly tapered panel contacting edge 43 which urges the panel to a vertically disposed direction that is at least 90° from the horizontal.

The panel urging element has a contact edge **44*a* for further acting on the extending panel to cause it to tilt package C to be further rotatably moved so that the panel is in a position to be disposed in an overlapping relationship with the next adjacent juxtaposed package B. At the same time that contact edge 44*a* is operating on the panel above package C, the box engaging edge 46*a* of box engaging element 46 is operating on the box portion of package C. This series of operation is clearly shown in the series of FIGS. 12 through 14**.

Figure 15:
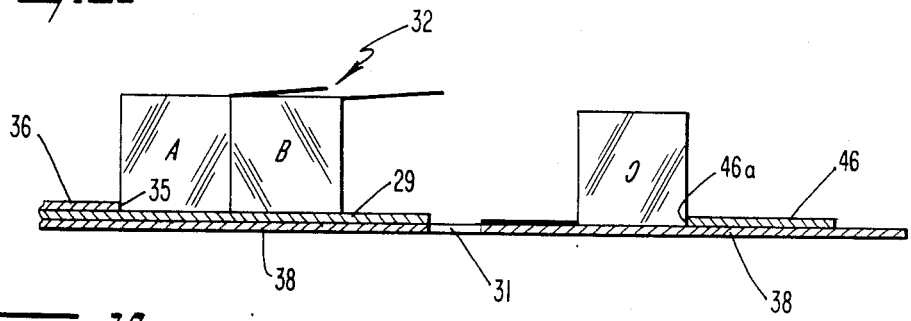
Figure 16:
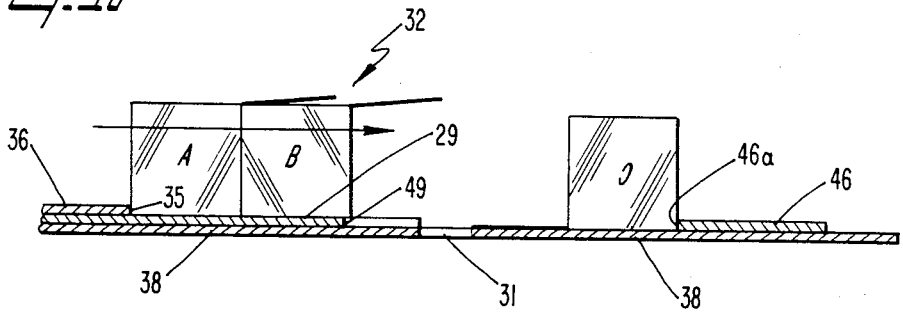
Figure 17:
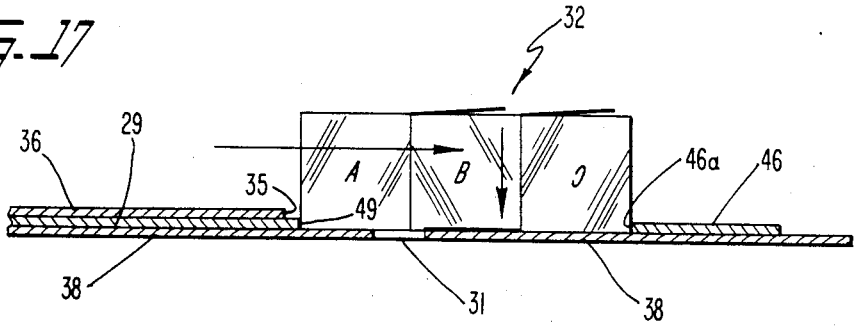
Figure 18:
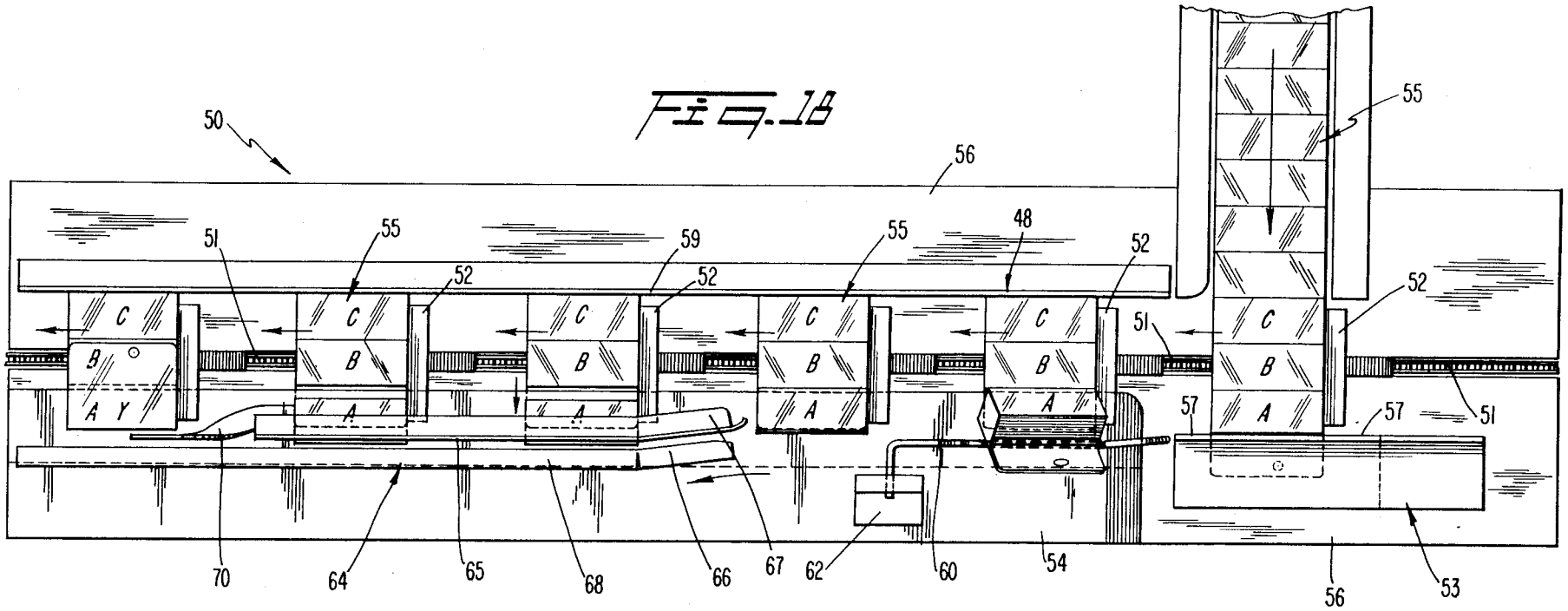
FIG. 18 is a top plan view of another embodiment of the invention made in accordance with this invention.
Figure 19:
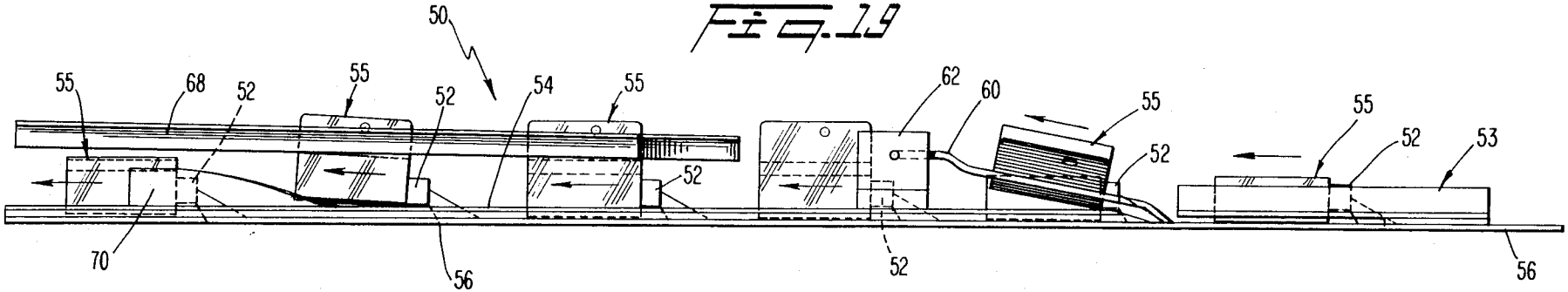
FIG. 19 is a side elevational view of the embodiment as shown in FIG. 18.
Figure 20:
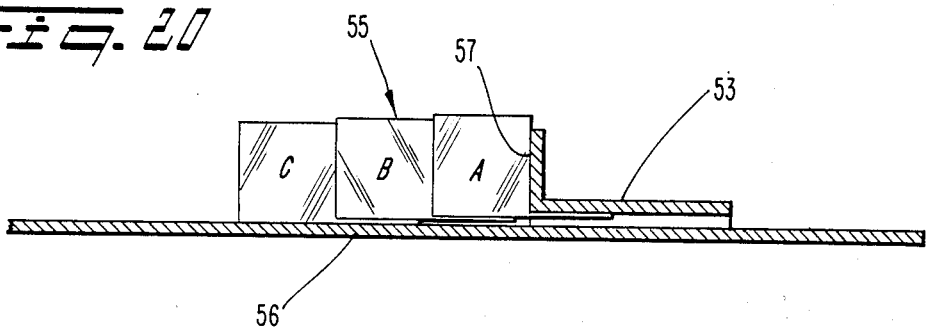
FIGS. 20 through 25 are sectional diagrammatic views showing the method of rotating the end package where the fifth panel of each package is below the plurality of packages.
Figure 21:
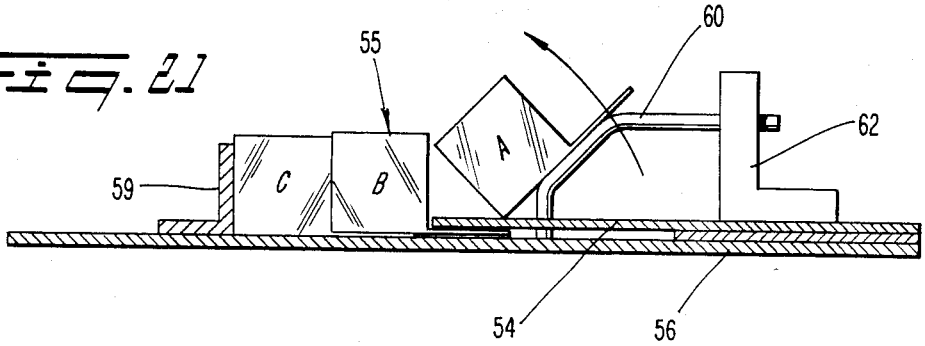
Figure 22:
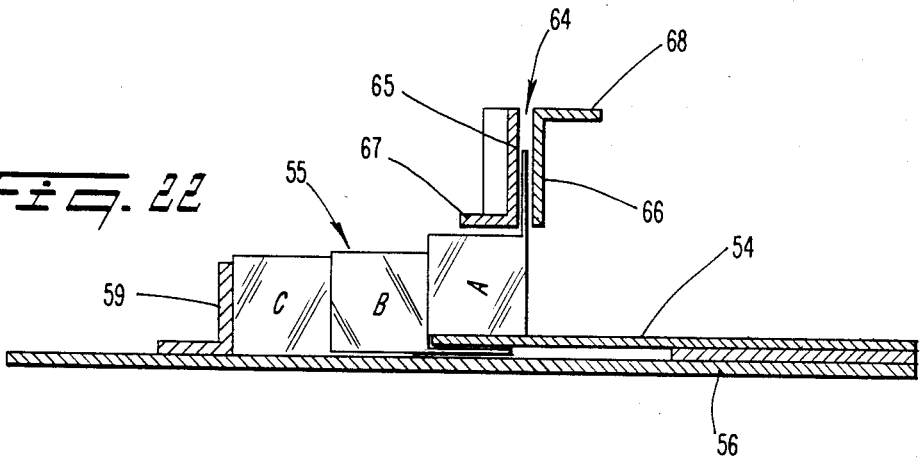
Figure 23:
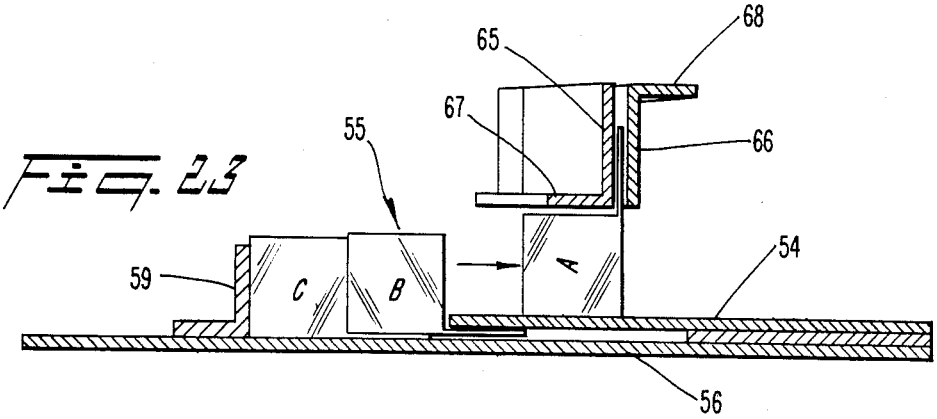
Figure 24:
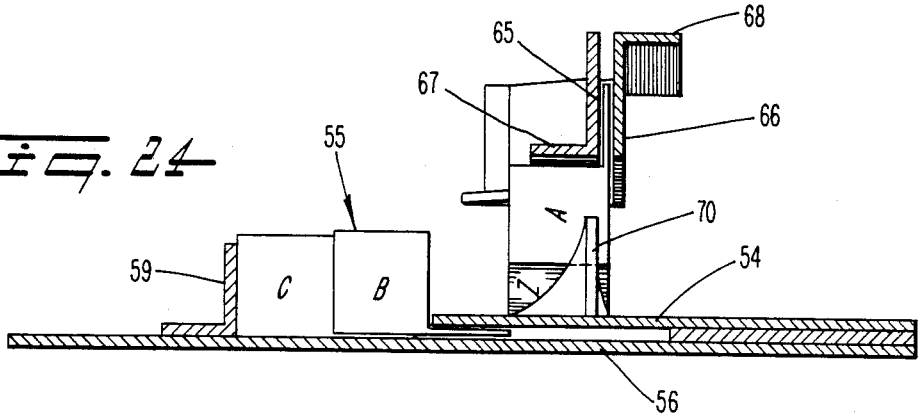
Figure 25:
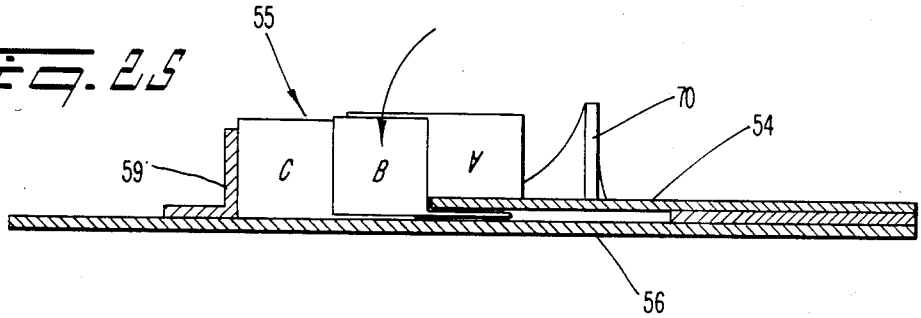

Once the end package C has been turned a half revolution as shown in FIG. 15, the outer plate guide edge 37 is designed to urge the entire package back toward the next adjacent juxtaposed package B. That is, the end package C is caused to be redisposed contiguously to the next adjacent package C after the rotating step as shown in FIGS. 16 and 17. The top plate 33 is cut away to form the cut out edge profile 49 allowing the next juxtaposed packages A and B to move downwardly so that the extending panels of packages C and B are disposed in a overlapping contiguous relationship with respect to the side of the other package as shown in FIG. 17. At this point, the plurality of packages 23 has reached the package discharge section of the work station 30.

In the embodiment shown in FIGS. 18 through 27, each overlapping extending panel is below the plurality of packages 8 with the end package A being rotated to place the extending panel on top of the next adjacent juxtaposed package B. Feeding means, generally designated 55, move packages along a first path to cause the packages to move in an initial direction of movement parallel to the direction in which the extending panels are disposed. Feed abutment member 53 stops movement of the packages along the first feed means 55 against the feed directing element 57. Pusher means mounted on chain 51 moving through slot 58 moves a selected number of nested packages 48 through the end package work station, generally designated 50.

Upon entry of the packages 48 into work station 50, the end package A is separated from the next adjacent package B to prepare package A for the rotating step. Thus, pusher member 52 pushes a selected number of packages 48 along a second path in a direction transverse to the initial direction of movement along the feed means 55. The panel contacting rail 60 initially contacts the panel of end package A which is also vertically shifted upwardly with respect to the next adjacent package B by movement along the end package support plate 54 which defines a vertically separate branch of the path through work station 50. Panel contacting rail 60 is held in place on support plate 54 by bracket member 62 as shown. Again, the panel in this embodiment is first turned in a vertically upward direction and then enters panel guide slot 64 formed between the inner slot surface 65 and outer slot surface 66 on inner slot defining member 67 and outer slot defining member 68, respectively. The path of movement of end package A is to laterally separate end package A from the next adjacent package B as shown.

Once separated to allow the completion of turning of the package A, the ramp member 70 provides a spirally disposed planar surface along which package A moves and subsequently tilts to complete the half-revolution so that its extending panel now overlaps the next adjacent juxtaposed package B as shown in the final position of work station 50.

Figure 26:
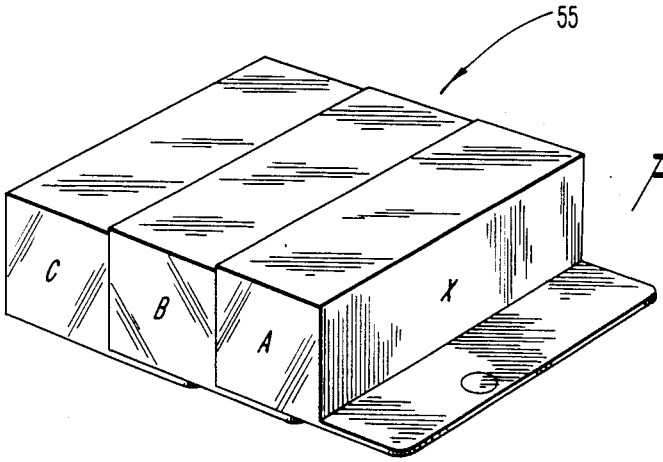
FIG. 26 is a perspective view of a selected number of contiguously disposed nested packages with the fifth panel of the end package extending outwardly therefrom.
Figure 27:
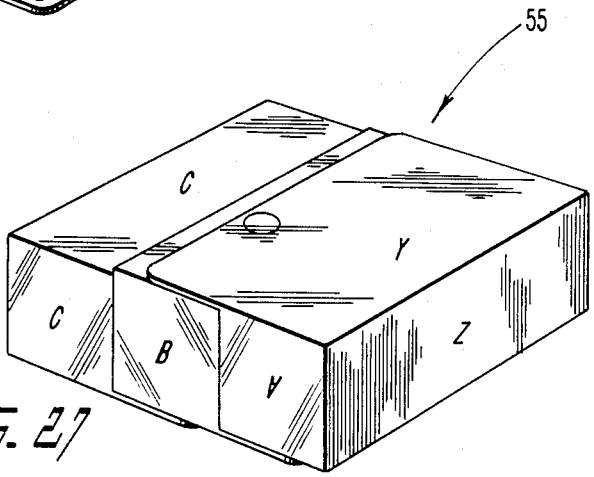
FIG. 27 is a perspective view of the selected number of packages as shown in FIG. 26 with the end package having been rotated to place the fifth panel in an overlapping relationship with respect to the side of the next adjacent juxtaposed package.

The entire series of rotational movement of end package A is shown in the series of FIGS. 20 through 25 with the FIG. 26 showing the selected number of packages at the beginning of work station 50 while the resultant package disposition once through work station 50 is shown in FIG. 27.

Lower support plate 56 extends the length of the separated branch for the next adjacent juxtaposed packages B and C. This branch is defined by the outer guide element 59 as shown throughout the FIGS. 18 through 25.

While the method of handling fifth panel packages and assembly therefor has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A method of handling packages having a panel extending outwardly from one side of the package and along one edge thereof, said method comprising the steps of:

(a) providing a plurality of said packages with the extending panel of each package disposed in the same direction, (b) said packages of said plurality being contiguously nested with respect to each other with each extending panel, except for the panel of an end package, overlapping the side of the next adjacent juxtaposed package, (c) said plurality of the nested packages including an end package with its extending panel directed outwardly from said plurality of the nested packages, and (d) rotating the end package and placing the extending panel thereof in an overlapping relationship with respect to the next adjacent juxtaposed package.

2. A method as defined in claim 1 wherein
the providing step includes moving the plurality of packages along a path extending in a direction transverse to the direction in which the extending panels are outwardly disposed.

3. A method as defined in claim 2 wherein
the moving of the plurality of packages is at substantially right angles to the direction in which the extending panels are disposed.

4. A method as defined in claim 2 wherein
the providing step includes feeding the packages along a first path to cause the packages to move in an initial direction of movement parallel to the direction in which the extending panels are disposed.

5. A method as defined in claim 2 wherein
the rotating step is effected simultaneously with the moving step.

6. A method as defined in claim 2 wherein
the transversely moving step includes laterally separating the end package from the next adjacent package to prepare the end package for the rotating step.

7. A method as defined in claim 6 wherein
the transversely moving step includes causing the end package to be redisposed contiguously to the next adjacent package after the rotating step.

8. A method as defined in claim 2 wherein
the transversely moving step includes vertically shifting the end package with respect to the next adjacent package to prepare the end package for the rotating step.

9. A method as defined in claim 8 wherein
each overlapping extending panel is below the plurality of packages with the end package being shifted vertically upwardly and then rotated to place the extending panel on top of the next adjacent juxtaposed package.

10. A method as defined in claim 8 wherein
each overlapping extending panel is above the plurality of packages with the end package being moved vertically downwardly and then rotated to place the extending panel below the next adjacent juxtaposed package.

11. A method as defined in claim 1 wherein
each overlapping extending panel is below the plurality of packages with the end package being rotated to place the extending panel on top of the next adjacent juxtaposed package.

12. A method as defined in claim 1 wherein
each overlapping extending panel is above the plurality of packages with the end package being rotated to place the extending panel below the next adjacent juxtaposed package.

13. A method as defined in claim 1 wherein
the rotating step includes acting upon the extending panel of the end package to cause the end package to rotatably move so that the panel is disposed in a direction at least 90° from the horizontal and, then, further acting on the extending panel to cause the package to be further rotatably moved so that the panel is disposed in said overlapping relationship.

14. A method as defined in claim 1 wherein
the packages have four substantially identical rectangular side panels with the outwardly extending panel being a fifth panel directed outwardly from the intersection of two of the four rectangular side panels.

15. A method as defined in claim 1 wherein
the end package is rotated through a half-revolution during the rotating step.

16. A method as defined in claim 1 wherein
the providing step includes separating the end package from the next adjacent package to prepare the end package for the rotating step.

17. A method as defined in claim 16 wherein
the rotating step includes turning the end package in a rotational direction within a plane parallel to the direction in which the panel outwardly extends.

18. A method as defined in claim 16 wherein
the separating step includes laterally disposing the end package to a position away from the next adjacent juxtaposed package.

19. A method as defined in claim 16 wherein
the separating step includes vertically disposing the end package to a position away from the next adjacent justaposed package.

20. An assembly for handling packages having a panel extending outwardly from one side of the package and along one edge thereof, said assembly comprising:

(a) means for providing a plurality of said packages with the extending panel of each package disposed in the same direction, (b) said packages of said plurality being contiguously nested with respect to each other with each extending panel, except for the panel of an end package, overlapping the side of the next adjacent juxtaposed package, (c) said plurality of the nested packages including an end package with its extending panel directed outwardly from said plurality of the nested packages, and (d) means for rotating the end package and placing the extending panel thereof in an overlapping relationship with respect to the next adjacent juxtaposed package.

21. An assembly as defined in claim 20 wherein the providing means includes means for moving the plurality of packages along a path extending in a direction transverse to the direction in which the extending panels are outwardly disposed.

22. An assembly as defined in claim 21 wherein the providing means includes means for feeding the packages along a first path to cause the packages to move in an initial direction of movement parallel to the direction in which the extending panels are disposed.

23. An assembly as defined in claim 22 wherein the moving means includes pusher means to push a selected number of said plurality of packages along a second path in a direction transverse to the initial direction of movement.

24. An assembly as defined in claim 23 wherein means for separating the end package from the next adjacent juxtaposed package in said selected number of packages is disposed along the second path, and the means for rotating the end package is disposed along the second path downstream from the separating means.

25. An assembly as defined in claim 24 wherein means for causing the end package to be redisposed contiguously to the next adjacent package is disposed along the second path downstream from the rotating means.

26. An assembly as defined in claim 25 wherein the separating means, the rotating means, and the redisposition causing means act in series upon the end package as the pusher means moves said selected number of packages along the second path.

27. An assembly as defined in claim 20 wherein the rotating means includes means acting upon the extending panel of the end package causing the end package to rotate a half-revolution.

28. An assembly as defined in claim 20 wherein the rotating means includes first means for acting upon the extending panel of the end package to cause the end package to rotate so that the panel is disposed in a direction at least 90° from the horizontal and second means for further acting on the extending panel to cause the end package to be further rotatably moved so that the panel is disposed in said overlapping relationship with respect to the next adjacent juxtaposed package.

29. An assembly as defined in claim 20 wherein the providing means includes means for moving the plurality of packages along a path extending in a direction transverse to the direction in which the extending panels are outwardly disposed, the moving means includes pusher means to push a selected number of said plurality of packages along said path in a direction transverse to the initial direction of movement, and means for separating the end package from the next adjacent juxtaposed package in said selected number of packages is disposed along said path.

30. An assembly as defined in claim 29 wherein said separating means includes means for laterally disposing the end package to a position away from the next adjacent juxtaposed package.

31. An assembly as defined in claim 29 wherein said separating means includes means for vertically disposing the end package to a position away from the next adjacent juxtaposed package.

32. An assembly as defined in claim 29 wherein the rotating means is disposed along said path downstream from the separating means.

33. An assembly as defined in claim 32 wherein the rotating means includes means for turning the end package in a rotational direction within a plane parallel to the direction in which the panel outwardly extends.

34. An assembly as defined in claim 20 wherein the providing means includes means to enhance the nesting of the plurality of packages.

35. An assembly as defined in claim 34 wherein the nesting enhancing means includes roller means disposed below the packages to cause them to shift with respect to each other thereby producing a substantially uniform overlapping disposition of the outwardly extending panels with respect to the side of the next adjacent juxtaposed package.

36. An assembly as defined in claim 35 wherein the roller means includes roller members mounted on closed loop chain means which move below the packages to cause the roller members to adjust the nested position of each package as the roller members contact each of the packages.

37. An assembly as defined in claim 20 wherein the providing means includes supporting surface means and conveyor means for moving the packages along the supporting surface means, the supporting surface means includes means defining a package path having separated branches located between a package ingress section and a package discharge section, one of said separated branches directing the end package along said path and the other of said separated branches directing the next adjacent juxtaposed package along said path a spaced distance from the end package.

38. An assembly as defined in claim 37 wherein the rotating means is disposed along the separated end package branch and includes a means for vertically shifting the end package with respect to the next adjacent juxtaposed package.

39. An assembly as defined in claim 38 wherein the rotating means includes extending panel contact means fixedly disposed on the supporting surface means to engage the extending panel of the end package thereby urging the end package to be rotated as the conveyor means moves the packages along said path.

* * * * *